US011612933B2

(12) United States Patent
Kim et al.

(10) Patent No.: US 11,612,933 B2
(45) Date of Patent: Mar. 28, 2023

(54) PREPARATION METHOD FOR METAL FOAM

(71) Applicant: LG CHEM, LTD., Seoul (KR)

(72) Inventors: So Jin Kim, Daejeon (KR); Dong Woo Yoo, Daejeon (KR); Jin Kyu Lee, Daejeon (KR)

(73) Assignee: LG CHEM, LTD., Seoul (KR)

( * ) Notice: Subject to any disclaimer, the term of this patent is extended or adjusted under 35 U.S.C. 154(b) by 221 days.

(21) Appl. No.: 16/627,139

(22) PCT Filed: Jul. 6, 2018

(86) PCT No.: PCT/KR2018/007707
§ 371 (c)(1),
(2) Date: Dec. 27, 2019

(87) PCT Pub. No.: WO2019/009672
PCT Pub. Date: Jan. 10, 2019

(65) Prior Publication Data

US 2020/0180030 A1 Jun. 11, 2020

(30) Foreign Application Priority Data

Jul. 6, 2017 (KR) ..... 10-2017-0086014

(51) Int. Cl.
*B22F 3/11* (2006.01)
*B22F 7/06* (2006.01)
*B22F 7/00* (2006.01)

(52) U.S. Cl.
CPC ..... *B22F 3/11* (2013.01); *B22F 3/1109* (2013.01); *B22F 7/002* (2013.01); *B22F 7/06* (2013.01); *B22F 2999/00* (2013.01)

(58) Field of Classification Search
CPC ..... B22F 1/0074; B22F 3/11; B22F 3/1103; B22F 3/1109; B22F 3/1115; B22F 3/1118;
(Continued)

(56) References Cited

U.S. PATENT DOCUMENTS

2005/0109617 A1 5/2005 Ono et al.
2011/0155662 A1 6/2011 Liu et al.
2015/0224576 A1* 8/2015 Lampenscherf ..... B22F 3/22 75/232

FOREIGN PATENT DOCUMENTS

CN 101336115 A 12/2008
CN 103894075 A 7/2014
(Continued)

OTHER PUBLICATIONS

International Search Report corresponding to PCT/KR2018/007707, dated Sep. 19, 2018 (2 pp).
(Continued)

*Primary Examiner* — Anthony J Zimmer
*Assistant Examiner* — Dean Mazzola
(74) *Attorney, Agent, or Firm* — Myers Bigel, P.A.

(57) ABSTRACT

A method for preparing a metal foam is provided which can freely control characteristics, such as pore size and porosity, of the metal foam, prepare the metal foam in the form of films or sheets which have conventionally been difficult to produce, particularly the form of thin films or sheets as well, and prepare a metal foam having excellent other physical properties such as mechanical strength. It is also possible to efficiently form a structure in which the metal foams as above are integrated with good adhesive force on a metal base material.

20 Claims, 2 Drawing Sheets

(58) Field of Classification Search
CPC ..... B22F 3/1121; B22F 3/1125; B22F 3/1137; B22F 3/114; B22F 3/1143; B22F 3/1146; B22F 5/006; B22F 7/002; B22F 7/006; B22F 7/06; B22F 2003/1131; B01D 39/2051; B32B 2255/062; B60B 2360/149; F01N 2330/22
See application file for complete search history.

(56) References Cited

FOREIGN PATENT DOCUMENTS

| | | | | |
|---|---|---|---|---|
| CN | 104507589 | A | | 4/2015 |
| CN | 104959611 | | | 10/2015 |
| CN | 106735235 | | | 5/2017 |
| DE | 102006039586 | | | 2/2008 |
| JP | 10251711 | A | * | 9/1998 |
| JP | H10251711 | A | | 9/1998 |
| JP | 2006077272 | | | 3/2006 |
| JP | 2007151805 | | | 6/2007 |
| JP | 2008056989 | A | | 3/2008 |
| JP | 2014522331 | | | 9/2014 |
| KR | 1020050040714 | | | 5/2005 |
| KR | 20140073957 | A | | 6/2014 |
| KR | 1020160018843 | | | 2/2016 |

OTHER PUBLICATIONS

Extended European Search Report corresponding to EP 18828216.4; dated Jun. 17, 2020 (6 pages).
Japanese Office Action corresponding to JP 2019-571220; dated Nov. 16, 2020 (14 pages, including English translation).

* cited by examiner

PREPARATION METHOD FOR METAL FOAM

CROSS REFERENCE TO RELATED APPLICATIONS

This application is a 35 U.S.C. § 371 national stage application of PCT International Application No. PCT/KR2018/007707, filed Jul. 6, 2018, which claims priority from Korean Patent Application No. 10-2017-0086014, filed Jul. 6, 2017, the contents of which are incorporated herein in their entireties by reference. The above-referenced PCT International Application was published in the Korean language as International Publication No. WO 2019/009672 on Jan. 10, 2019.

TECHNICAL FIELD

The present application relates to a method for preparing a metal foam.

BACKGROUND ART

Metal foams can be applied to various fields including lightweight structures, transportation machines, building materials or energy absorbing devices, and the like by having various and useful properties such as lightweight properties, energy absorbing' properties, heat insulating properties, refractoriness or environment-friendliness. In addition, metal foams not only have a high specific surface area, but also can further improve the flow of fluids, such as liquids and gases, or electrons, and thus can also be usefully used by being applied in a substrate for a heat exchanger, a catalyst, a sensor, an actuator, a secondary battery, a gas diffusion layer (GDL) or a microfluidic flow controller, and the like.

DISCLOSURE

Technical Problem

It is one object of the present application to provide a method which can freely control characteristics, such as pore size and porosity, of the metal foam, prepare the metal foam in the form of films or sheets which have conventionally been difficult to produce, particularly the form of thin films or sheets as well, and prepare a metal foam having excellent other physical properties such as mechanical strength. In addition, it is another object of the present application to provide a preparation method capable of controlling pore characteristics so as to change in the interior of a single metal foam.

TECHNICAL SOLUTION

Figure 1:
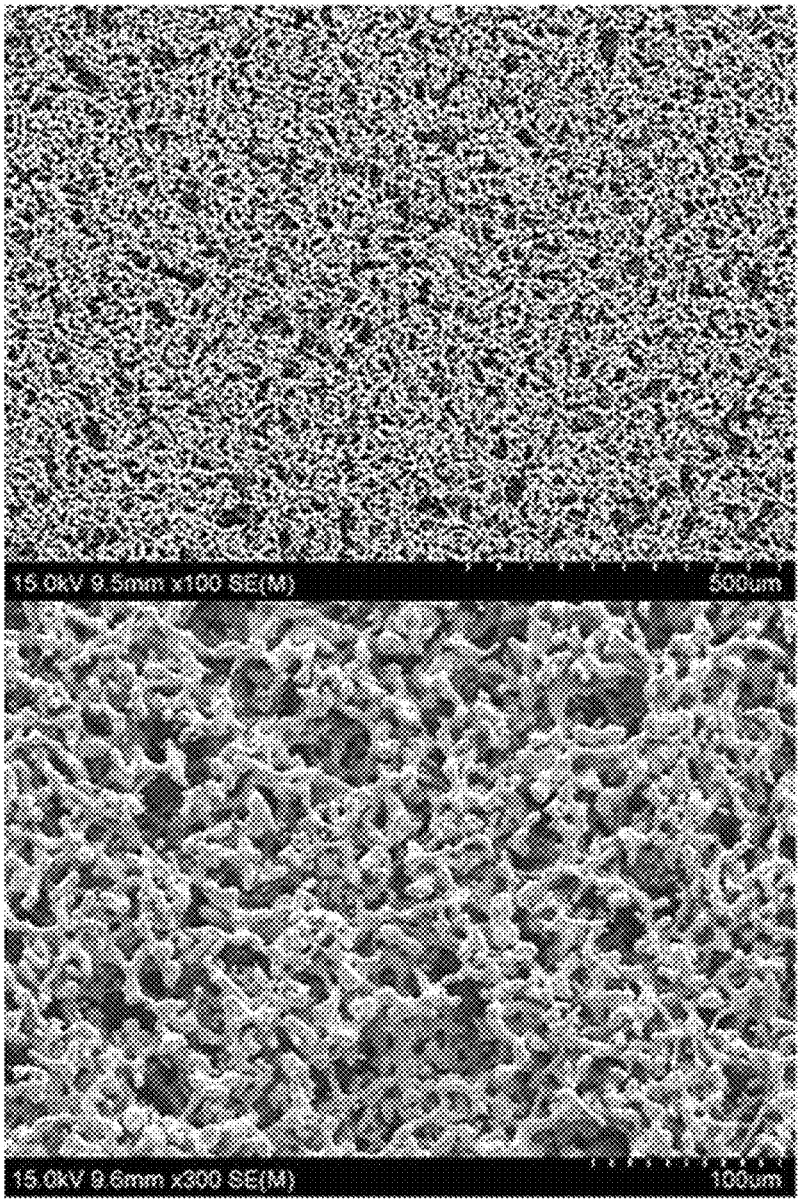
FIG. 1 and FIG. 2 are SEM photographs of metal foams formed in Examples.

In the present application, the term metal foam or metal skeleton means a porous structure comprising a metal as a main component. Here, the metal as a main component means that the ratio of the metal is 55 wt % or more, 60 wt % or more, 65 wt % or more, 70 wt % or more, 75 wt % or more, 80 wt % or more, 85 wt % or more, 90 wt % or more, or 95 wt % or more based on the total weight of the metal foam or the metal skeleton. The upper limit of the ratio of the metal contained as the main component is not particularly limited. For example, the ratio of the metal may be 100 wt % or less, or less than about 100 wt %.

The term porous property may mean a case where porosity is at least 30% or more, 40% or more, 50% or more, 60% or more, 70% or more, 75% or more, or 80% or more. The upper limit of the porosity is not particularly limited, and may be, for example, less than about 100%, about 99% or less, or about 98% or less or so. Here, the porosity can be calculated in a known manner by calculating the density of the metal foam or the like.

The method for preparing a metal foam of the present application may comprise a step of sintering a metal foam precursor comprising a metal component. In the present application, the term metal foam precursor means a structure before the process performed to form the metal foam, such as the sintering process, that is, a structure before the metal foam is formed. In addition, even when the metal foam precursor is referred to as a porous metal foam precursor, it is not necessarily porous per se, and may be referred to as a porous metal foam precursor for convenience, if it can finally form a metal foam, which is a porous metal structure.

In the present application, the metal foam precursor may be formed using a slurry containing at least a metal component, a dispersant, and a binder.

Here, as the metal component, metal powder may be applied. An example of the applicable metal powder is determined depending on purposes, which is not particularly limited, but it can be exemplified by any one powder selected from the group consisting of copper powder, molybdenum powder, silver powder, platinum powder, gold powder, aluminum powder, chromium powder, indium powder, tin powder, magnesium powder, phosphorus powder, zinc powder and manganese powder, metal powder mixed with two or more of the foregoing or a powder of an alloy of two or more of the foregoing, without being limited thereto.

If necessary, the metal component may comprise, as an optional component, a metal component having relative magnetic permeability and conductivity in a predetermined range. Such a metal component can be helpful in selecting an induction heating method in a sintering process. However, since the sintering does not necessarily have to proceed by the induction heating method, the metal component having the above magnetic permeability and conductivity is no essential component.

In one example, as the metal powder which can be optionally added, metal powder having relative magnetic permeability of 90 or more may be used. The term relative magnetic permeability ($\mu_r$) is a ratio ($\mu/\mu_0$) of the magnetic permeability ($\mu$) of the relevant material to the magnetic permeability ($\mu_0$) in the vacuum. In another example, the relative magnetic permeability may be 95 or more, 100 or more, 110 or more, 120 or more, 130 or more, 140 or more, 150 or more, 160 or more, 170 or more, 180 or more, 190 or more, 200 or more, 210 or more, 220 or more, 230 or more, 240 or more, 250 or more, 260 or more, 270 or more, 280 or more, 290 or more, 300 or more, 310 or more, 320 or more, 330 or more, 340 or more, 350 or more, 360 or more, 370 or more, 380 or more, 390 or more, 400 or more, 410 or more, 420 or more, 430 or more, 440 or more, 450 or more, 460 or more, 470 or more, 480 or more, 490 or more, 500 or more, 510 or more, 520 or more, 530 or more, 540 or more, 550 or more, 560 or more, 570 or more, 580 or more, or 590 or more. The upper limit of the relative magnetic permeability is not particularly limited because the higher the value is, the more advantageous it is in the case where the induction heating is applied. In one example, the upper limit of the relative magnetic permeability may be, for example, about 300,000 or less.

The metal powder that can be optionally added may also be conductive metal powder. In the present application, the term conductive metal powder may mean a powder of a metal or an alloy thereof having conductivity at 20° C. of about 8 MS/m or more, 9 MS/m or more, 10 MS/m or more, 11 MS/m or more, 12 MS/m or more, 13 MS/m or more, or 14.5 MS/m. The upper limit of the conductivity is not particularly limited, and for example, may be about 30 MS/m or less, 25 MS/m or less, or 20 MS/m or less.

In the present application, the metal powder having the relative magnetic permeability and conductivity may also be simply referred to as conductive magnetic metal powder.

A specific example of such conductive magnetic metal powder can be exemplified by a powder of nickel, iron or cobalt, and the like, but is not limited thereto.

If used, the ratio of the conductive magnetic metal powder in the entire metal powder is not particularly limited. For example, the ratio may be adjusted so that the ratio may generate appropriate Joule heat upon the induction heating. For example, the metal powder may comprise 30 wt % or more of the conductive magnetic metal powder based on the weight of the entire metal powder. In another example, the ratio of the conductive magnetic metal powder in the metal powder may be about 35 wt % or more, about 40 wt % or more, about 45 wt % or more, about 50 wt % or more, about 55 wt % or more, 60 wt % or more, 65 wt % or more, 70 wt % or more, 75 wt % or more, 80 wt % or more, 85 wt % or more, or 90 wt % or more. The upper limit of the conductive magnetic metal powder ratio is not particularly limited, and may be, for example, less than about 100 wt %, or 95 wt % or less. However, the above ratios are exemplary ratios.

The size of the metal powder is also selected in consideration of the desired porosity or pore size, and the like, but is not particularly limited, where the metal powder may have an average particle diameter, for example, in a range of about 0.1 μm to about 200 μm. In another example, the average particle diameter may be about 0.5 μm or more, about 1 μm or more, about 2 μm or more, about 3 μm or more, about 4 μm or more, about 5 μm or more, about 6 μm or more, about 7 μm or more, or about 8 μm or more. In another example, the average particle diameter may be about 150 μm or less, 100 μm or less, 90 μm or less, 80 μm or less, 70 μm or less, 60 μm or less, 50 μm or less, 40 μm or less, 30 μm or less, or 20 μm or less. As the metal in the metal particles, one having different average particle diameters may also be applied. The average particle diameter can be selected from an appropriate range in consideration of the shape of the desired metal foam, for example, the thickness or porosity of the metal foam, and the like.

Here, the average particle diameter of the metal powder may be obtained by a known particle size analysis method, and for example, the average particle diameter may be a so-called D50 particle diameter.

The ratio of the metal component (metal powder) in the slurry as above is not particularly limited, which may be selected in consideration of the desired viscosity and process efficiency. In one example, the ratio of the metal component in the slurry may be 0.5 10 to 95% or so on the basis of weight, but is not limited thereto. In another example, the ratio may be about 1% or more, about 1.5% or more, about 2% or more, about 2.5% or more, about 3% or more, about 5% or more, 10% or more, 15% or more, 20% or more, 25% or more, 30% or more, 35% or more, 40% or more, 45% or more, 50% or more, 55% or more, 60% or more, 65% or more, 70% or more, 75% or more, or 80% or more, or may be about 90% or less, about 85% or less, about 80% or less, about 75% or less, about 70% or less, about 65% or less, 60% or less, 55% or less, 50% or less, 45% or less, 40% or less, 35% or less, 30% or less, 25% or less, 20% or less, 15% or less, 10% or less, or 5% or less, but is not limited thereto.

The metal foam precursor may be formed by using a slurry comprising a dispersant and a binder together with the metal powder.

Here, as the dispersant, for example, an alcohol may be applied. As the alcohol, a monohydric alcohol having 1 to 20 carbon atoms such as methanol, ethanol, propanol, pentanol, octanol, ethylene glycol, propylene glycol, pentanol, 2-methoxyethanol, 2-ethoxyethanol, 2-butoxyethanol, glycerol, texanol, or terpineol, or a dihydric alcohol having 1 to 20 carbon atoms such as ethylene glycol, propylene glycol, hexane diol, octane diol or pentane diol, or a polyhydric alcohol, etc., may be used, but the kind is not limited to the above.

The slurry may further comprise a binder. The kind of the binder is not particularly limited and may be appropriately selected depending on the kind of the metal component or the dispersant, and the like applied at the time of producing the slurry. For example, the binder may be exemplified by alkyl cellulose having an alkyl group having 1 to 8 carbon atoms such as methyl cellulose or ethyl cellulose, polyalkylene carbonate having an alkylene unit having 1 to 8 carbon atoms such as polypropylene carbonate or polyethylene carbonate, or a polyvinyl alcohol-based binder (hereinafter, may be referred to as a polyvinyl alcohol compound) such as polyvinyl alcohol or polyvinyl acetate, and the like, but is not limited thereto.

The ratio of each component in the slurry as above is not particularly limited. This ratio can be adjusted in consideration of process efficiency such as coating property and moldability upon a process of using the slurry.

For example, in the slurry, the binder may be included in a ratio of about 1 to 500 parts by weight relative to 100 parts by weight of the above-described metal component. In another example, the ratio may be about 2 parts by weight or more, about 3 parts by weight or more, about 4 parts by weight or more, about 5 parts by weight or more, about 6 parts by weight or more, about 7 parts by weight or more, about 8 parts by weight or more, about 9 parts by weight or more, about 10 parts by weight or more, about 20 parts by weight or more, about 30 parts by weight or more, about 40 parts by weight or more, about 50 parts by weight or more, about 60 parts by weight or more, about 70 parts by weight or more, about 80 parts by weight or more, or about 90 parts by weight or more, about 100 parts by weight or more, about 110 parts by weight or more, about 120 parts by weight or more, about 130 parts by weight or more, about 140 parts by weight or more, about 150 parts by weight or more, about 200 parts by weight or more, or about 250 parts by weight or more, and may be about 450 parts by weight or less, about 400 parts by weight or less, about 350 parts by weight or less, about 300 parts by weight or less, about 250 parts by weight or less, about 200 parts by weight or less, about 150 parts by weight or less, about 100 parts by weight or less, about 50 parts by weight or less, about 40 parts by weight or less, about 30 parts by weight or less, about 20 parts by weight or less, or about 10 parts by weight or less.

In the slurry, the dispersant may be contained at a ratio of about 10 to 3,000 parts by weight relative to 100 parts by weight of the binder. In another example, the ratio may be about 20 parts by weight or more, about 30 parts by weight or more, about 40 parts by weight or more, about 50 parts by weight or more, about 60 parts by weight or more, about 70 parts by weight or more, about 80 parts by weight or more, about 90 parts by weight or more, about 100 parts by weight or more, about 200 parts by weight or more, about 300 parts by weight or more, about 400 parts by weight or more, about 500 parts by weight or more, about 550 parts by weight or more, about 600 parts by weight or more, or about 650 parts by weight, and may be about 2,800 parts by weight or less, about 2,600 parts by weight or less, about 2,400 parts by weight or less, about 2,200 parts by weight or less, about 2,000 parts by weight or less, about 1,800 parts by weight or less, about 1,600 parts by weight or less, about 1,400 parts by weight or less, about 1,200 parts by weight or less, or about 1,000 parts by weight or less or so.

In this specification, the unit part by weight means a weight ratio between the respective components, unless otherwise specified.

The slurry may further comprise a solvent, if necessary. However, according to one example of the present application, the slurry may not contain the solvent. That is, even if the dispersant is regarded as a solvent, the solvent component other than the dispersant may not be included, whereby the method of the present application can be more effectively performed. As the solvent, an appropriate solvent may be used in consideration of solubility of the slurry component, for example, the metal component or the binder, and the like. For example, as the solvent, those having a dielectric constant within a range of about 10 to 120 can be used. In another example, the dielectric constant may be about 20 or more, about 30 or more, about 40 or more, about 50 or more, about 60 or more, or about 70 or more, or may be about 110 or less, about 100 or less, or about 90 or less. Such a solvent may be exemplified by water, an alcohol having 1 to 8 carbon atoms such as ethanol, butanol or methanol, DMSO (dimethyl sulfoxide), DMF (dimethyl formamide) or NMP (N-methylpyrrolidinone), and the like, but is not limited thereto.

When a solvent is applied, it may be present in the slurry at a ratio of about 50 to 400 parts by weight relative to 100 parts by weight of the binder, but is not limited thereto. In another example, the ratio of the solvent may be about 60 parts by weight or more, about 70 parts by weight or more, about 80 parts by weight or more, about 90 parts by weight or more, about 100 parts by weight or more, about 110 parts by weight or more, about 120 parts by weight or more, about 130 parts by weight or more, about 140 parts by weight or more, about 150 parts by weight or more, about 160 parts by weight or more, about 170 parts by weight or more, about 180 parts by weight or more, or about 190 parts by weight or more, or may be 300 parts by weight or less, or 250 parts by weight or less, but is not limited thereto.

The slurry may also comprise, in addition to the above-mentioned components, known additives which are additionally required. However, the process of the present application may be performed using a slurry comprising no blowing agent among known additives.

The method of forming the metal foam precursor using the slurry as above is not particularly limited. In the field of producing metal foams, various methods for forming the metal foam precursor are known, and in the present application all of these methods can be applied. For example, the metal foam precursor may be formed by holding the slurry in an appropriate template, or by coating the slurry in an appropriate manner.

In one example of the present application, when the metal foam precursor is formed using the slurry, a method of using slurries having at least two different compositions may be applied. Here, the fact that the slurries have different compositions means a case where the two slurries equally comprise at least metal powder; a binder; and a dispersant, but different components are used as at least one component of the metal powder, the binder and the dispersant, a case where even when the three components are used in the same kinds, their compounding ratios are different, or a case where the kinds and compounding ratios are all different, and the like.

Accordingly, the preparation method of the present application may comprise steps of forming a first metal foam precursor using a first slurry; and forming a second metal foam precursor on the first metal foam precursor using a second slurry having a composition different from that of the first slurry.

Here, the first and second slurries may each comprise metal powder, a binder and a dispersant, but their compositions are different as mentioned above.

In addition to the steps of forming the two metal foam precursors with the two slurries, the preparation method of the present application may also prepare three or more metal foam precursors using other slurries, wherein in the case of using three or more slurries in this way, if at least two of them have different compositions, the remaining composition may also be the same as that of the other slurry.

As described above, the first and second slurries may each comprise 1 to 500 parts by weight of the binder relative to 100 parts by weight of the metal powder; and 10 to 3,000 parts by weight of the dispersant relative to 100 of the binder, where the detailed types of the metal powder, the binder and the dispersant are as described above, but the compositions of the first and second slurries are different from each other.

When the metal foam precursors are formed through the above steps, the first and second metal foam precursors may also be formed to be in contact with each other, and if necessary, another element such as a metal sheet may also exist between the first and second metal foam precursors.

In one example, the first and second slurries may have at least different weight ratios of the metal powder contained therein. In this case, the ratio (A/B) of the weight ratio (A, wt %) of the metal powder in the first slurry to the weight ratio (B, wt %) of the metal powder in the second slurry may be in a range of about 0.1 to 20. In another example, the ratio (A/B) may be about 0.3 or more, 0.5 or more, 0.7 or more, 0.9 or more, or 1 or more, or may be about 18 or less, 16 or less, 14 or less, 12 or less, 11 or less, 10 or less, 9 or less, 8 or less, 7 or less, 6 or less, 5 or less, 4 or less, 3 or less, or 2.5 or less.

In one example, the first and second slurries may have at least different ratios of the binder contained therein. In this case, the ratio (C/D) of the parts by weight (C) of the binder relative to 100 parts by weight of the metal powder in the first slurry to the parts by weight (D) of the binder relative to 100 parts by weight of the metal powder in the second slurry may be in a range of 0.01 to 20. In another example, the ratio (C/D) may be about 0.05 or more, 0.1 or more, 0.2 or more, or 0.3 or more, or may be about 18 or less, 16 or less, 14 or less, 12 or less, 11 or less, 10 or less, 9 or less, 8 or less, 7 or less, 6 or less, 5 or less, 4 or less, 3 or less, 2 or less, or 1.5 or less or so.

In one example, the first and second slurries may have at least different ratios of the dispersant contained therein. In this case, the ratio (E/F) of the parts by weight (E) of the dispersant relative to 100 parts by weight of the metal powder in the first slurry to the parts by weight (F) of the dispersant relative to 100 parts by weight of the metal powder in the second slurry may be in a range of 0.01 to 20. In another example, the ratio (C/D) may be about 0.05 or more, 0.1 or more, 0.2 or more, or 0.3 or more, or may be about 18 or less, 16 or less, 14 or less, 12 or less, 11 or less, 10 or less, 9 or less, 8 or less, 7 or less, 6 or less, 5 or less, 4 or less, 3 or less, 2 or less or 1.5 or less, or about 1 or less or so.

For example, if three or more slurries are applied upon preparing the metal foam precursors, at least two of them may satisfy the relationship.

In this case, it is advantageous for effective application of the disclosed method of the present application that among the first slurry and the second slurry satisfying the above relationship, the first slurry forms a metal foam precursor first by application or the like, and then the second slurry forms a metal foam precursor thereon.

Therefore, when the metal foam precursors are formed using the first and second slurries satisfying the above relationship, the first metal precursor may exist in the gravity direction of the second metal precursor based on the second metal precursor. That is, the second metal precursor may be present on top of the first metal precursor.

It may be advantageous to apply a coating process when producing metal foams in the form of films or sheets according to one example of the present application, especially when producing metal foams in the form of thin films or sheets. For example, the desired metal foam may be formed by coating the slurry on a suitable base material to form a precursor, followed by the sintering process to be described below.

The shape of such a metal foam precursor is not particularly limited as it is determined depending on the desired metal foam. In one example, the metal foam precursor may be in the form of a film or sheet. For example, when the precursor is in the form of a film or sheet, the thickness may be 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. Metal foams have generally brittle characteristics due to their porous structural features, so that there are problems that they are difficult to be produced in the form of films or sheets, particularly thin films or sheets, and are easily broken even when they are made. However, according to the method of the present application, it is possible to form a metal foam having pores uniformly formed inside and excellent mechanical properties as well as a thin thickness.

Here, the lower limit of the precursor thickness is not particularly limited. For example, the film or sheet shaped precursor may have a thickness of about 5 μm or more, 10 μm or more, or about 15 μm or more.

The precursor thickness is the total thickness including the first and second metal foam precursors, and if there is another metal foam precursor, the thickness of the precursor may also be a combined thickness. The ratio of the thickness of each sub precursor in the entire metal foam precursor can be appropriately adjusted according to the purpose without any particular limitation.

If necessary, a suitable drying process may also be performed during a process of forming the metal foam precursor. For example, the metal foam precursor may also be formed by forming the slurry by the above-described coating method or the like and then drying it constant time. The drying may also be performed after forming each of the precursors when forming a plurality of metal foam precursors, and may also be performed finally after all of the metal foam precursors are formed. The conditions of the drying are not particularly limited and can be controlled, for example, at a level where the solvent contained in the slurry can be removed to a desired level. For example, the drying may be performed by maintaining the formed slurry at a temperature in a range of about 50° C. to 250° C., about 70° C. to 180° C., or about 90° C. to 150° C. for an appropriate time. The drying time can also be selected in an appropriate range.

In one example, the metal foam precursor may be formed on a metal substrate. For example, the metal foam precursor may be formed by coating the above-described slurry on a metal substrate, and if necessary, through the above-described drying process. Depending on the application of the metal foam, it may be necessary to form the metal foam on a metal base material (substrate). Therefore, conventionally, the metal foam has been attached on a metal base material to form the above structure. However, this method has difficulty in securing adhesion between the metal foam and the metal base material, and particularly, it has had difficulty in attaching a thin metal foam on the metal base material. However, according to the method disclosed in the present application, even in the case of a metal foam having a thin thickness, it can be formed on a metal base material with good adhesive force. If necessary, a metal substrate may also be positioned between the precursors.

The type of the metal base material is determined depending on purposes, which is not particularly limited, and for example, a base material of the same metal as or the different metal from the metal foam can be applied.

For example, the metal base material may be a base material of any one metal selected from the group consisting of copper, molybdenum, silver, platinum, gold, aluminum, chromium, indium, tin, magnesium, phosphorus, zinc and manganese, or a base material of a mixture or an alloy of two or more thereof, and if necessary, a base material of any one selected from the group consisting of nickel, iron and cobalt, which are the above-described conductive magnetic metals, or a mixture or alloy of two or more thereof, or a base material of a mixture or alloy of the conductive magnetic metal and the above other metals, and the like may also be used.

The thickness of such a metal base material is not particularly limited, which may be suitably selected depending on purposes.

The metal foam can be prepared by sintering the metal foam precursor formed in the above manner. In this case, a method of performing the sintering for producing the metal foam is not particularly limited, and a known sintering method can be applied. That is, the sintering can proceed by a method of applying an appropriate amount of heat to the metal foam precursor in an appropriate manner.

In this case, the conditions of the sintering may be controlled, in consideration of the state of the applied metal precursor, for example, the kind and amount of the metal powder, or the kind and amount of the binder or dispersant, and the like, such that while the metal powder is connected to form the porous structure, the binder and the dispersant, and the like may be removed, where the specific conditions are not particularly limited.

For example, the sintering can be performed by maintaining the precursor at a temperature in a range of about 500° C. to 2000° C., in a range of 700° C. to 1500° C., or in a range of 800° C. to 1200° C., and the holding time may also be selected optionally. In one example, the holding time may be in a range of about 1 minute to 10 hours, but is not limited thereto.

That is, as described above, the sintering may be controlled, in consideration of the state of the applied metal precursor, for example, the kind and amount of the metal powder, or the kind and amount of the binder or dispersant, and the like, such that while the metal powder is connected to form the porous structure, the binder and the dispersant, and the like may be removed.

The present application also relates to a metal foam. The metal foam may be one produced by the above-described method. In one example, such a metal foam may be in the form of being attached on the above-described metal base material or substrate.

The metal foam may have porosity in a range of about 40% to 99%. As mentioned above, according to the method of the present application, porosity and mechanical strength can be controlled, while comprising uniformly formed pores. The porosity may be 50% or more, 60% or more, 70% or more, 75% or more, or 80% or more, or may be 95% or less, or 90% or less.

Furthermore, since a unit using different kinds of slurries is included, the porosity may vary with a gradient along the thickness direction of the metal foam, or may also vary irregularly.

The metal foam may also be present in the form of thin films or sheets. In one example, the metal foam may be in the form of a film or sheet. The metal foam of such a film or sheet form may have a thickness of 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. For example, the film or sheet shaped metal foam may have a thickness of about 10 μm or more, about 20 μm or more, about 30 μm or more, about 40 μm or more, about 50 μm or more, about 100 μm or more, about 150 μm or more, about 200 μm or more, about 250 μm or more, about 300 μm or more, about 350 μm or more, about 400 μm or more, about 450 μm or more, or about 500 μm or more.

The metal foam may have excellent mechanical strength, and for example, may have tensile strength of 2.5 MPa or more, 3 MPa or more, 3.5 MPa or more, 4 MPa or more, 4.5 MPa or more, or 5 MPa or more. Also, the tensile strength may be about 10 MPa or more, about 9 MPa or more, about 8 MPa or more, about 7 MPa or more, or about 6 MPa or less. Such tensile strength can be measured, for example, by KS B 5521 at room temperature.

Such metal foams can be utilized in various applications where a porous metal precursor is required. In particular, according to the method of the present application, it is possible to produce a thin film or sheet shaped metal foam having excellent mechanical strength as well as the desired level of porosity, as described above, thus expanding applications of the metal foam as compared to the conventional metal foam.

Examples of metal foams that can be applied include machine tool saddles, heat dissipation materials, sound absorbing materials, heat insulating materials, heat exchangers, heat sinks, dustproof materials, battery materials such as electrodes, and the like, but are not limited thereto.

Advantageous Effects

The present application provides a method which can freely control characteristics, such as pore size and porosity, of the metal foam, prepare the metal foam in the form of films or sheets which have conventionally been difficult to produce, particularly the form of thin films or sheets as well, and prepare a metal foam having excellent other physical properties such as mechanical strength. According to one example of the present application, it is possible to efficiently form a structure in which such a metal foam is integrated on a metal base material with good adhesive force.

Mode for Invention

Hereinafter, the present application will be described in detail by way of examples and comparative examples, but the scope of the present application is not limited to the following examples.

EXAMPLE 1

Figure 2:
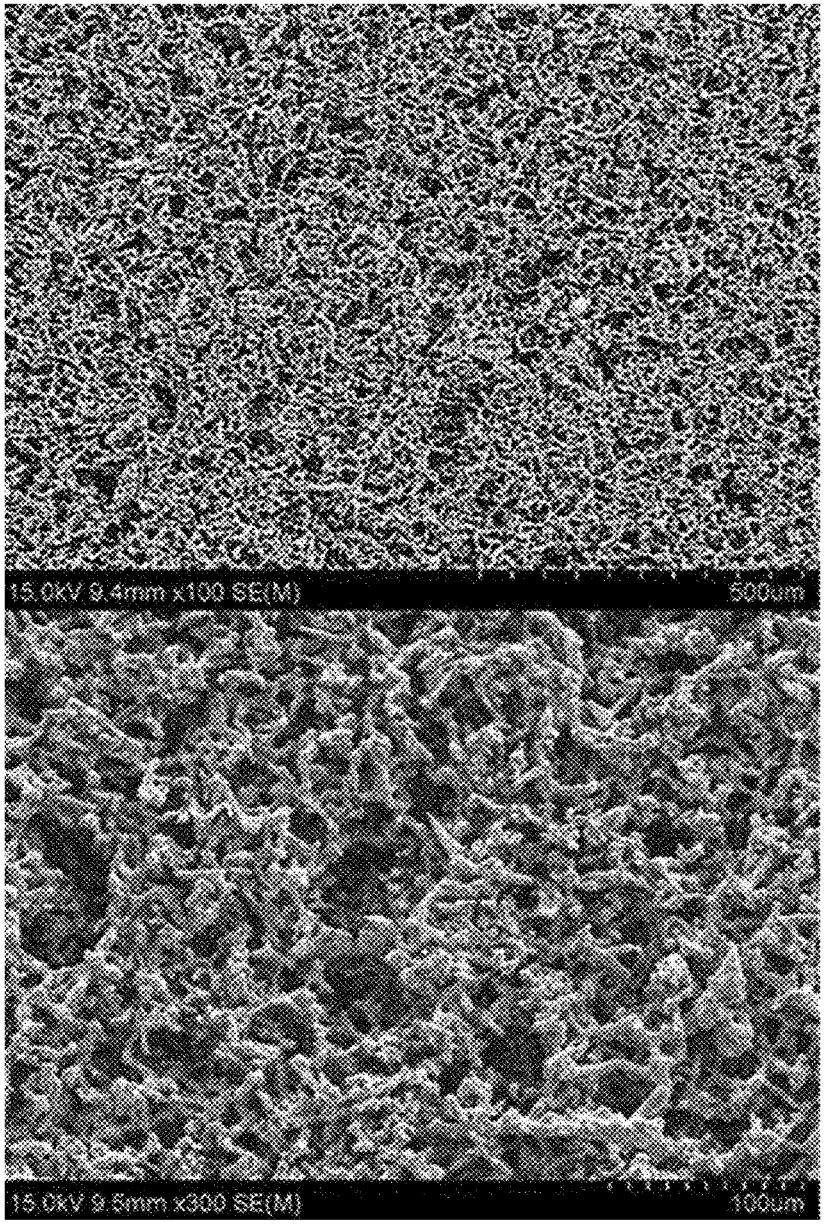

Copper (Cu) powder having an average particle diameter (D50 particle diameter) of about 10 to 20 μm, polyvinyl acetate as a binder and alpha-terpineol as a dispersant were mixed in a weight ratio of 5:0.5:4.5 (copper powder:binder:dispersant) to prepare a first slurry. In addition, copper (Cu) powder having an average particle diameter (D50 particle diameter) of about 10 to 20 μm, polyvinyl acetate as a binder and alpha-terpineol as a dispersant were equally mixed in a weight ratio of 2.5:0.5:4.5 (copper powder:binder:dispersant) to prepare a second slurry. First, the first slurry was coated in the form of a film and dried at about 100° C. for about 30 minutes to form a first metal foam precursor. At this time, the thickness of the coated metal foam precursor was about 200 μm or so. Subsequently, the second slurry was also coated on the first metal precursor in the form of a film and dried at about 100° C. for about 30 minutes to form a second metal foam precursor. At this time, the thickness of the coated second metal foam precursor was about 200 μm or so. Subsequently, the laminate was heat-treated (sintered) at a temperature of 900° C. for 2 hours in a 4% hydrogen/argon gas atmosphere to prepare a metal foam. Here, the porosity of the metal foam formed by the first slurry is about 74% and the porosity of the metal foam portion formed by the second slurry is about 80%. The porosity is a value measured on a single metal foam made of the first or second slurry. The attached FIG. 1 is a photograph of a surface of the metal foam on which the first metal foam precursor was present, and FIG. 2 is a photograph of a surface of the metal foam on which the second metal foam precursor was present.

EXAMPLE 2

Copper (Cu) powder having an average particle diameter (D50 particle diameter) of about 10 to 20 μm, ethyl cellulose as a binder and texanol as a dispersant were mixed in a weight ratio of 5:0.72:5.28 (copper powder:binder:dispersant) to prepare a first slurry. In addition, copper (Cu) powder having an average particle diameter (D50 particle diameter) of about 10 to 20 μm, polyvinyl acetate as a binder and beta-terpineol as a dispersant were mixed in a weight ratio of 2.5:0.33:6.27 (copper powder:binder:dispersant) to prepare a second slurry. First, the first slurry was coated in the form of a film and dried at about 125° C. for about 15 minutes to form a first metal foam precursor. At this time, the thickness of the coated metal foam precursor was about 200 μm or so. Subsequently, the second slurry was also coated on the first metal precursor in the form of a film and dried at about 125° C. for about 15 minutes to form a second metal foam precursor. At this time, the thickness of the coated second metal foam precursor was about 200 μm or so.

Subsequently, the laminate was heat-treated (sintered) at a temperature of 1,000° C. for 1 hour in a 4% hydrogen/argon gas atmosphere to prepare a metal foam. Here, the porosity of the metal foam formed by the first slurry is about 74% and the porosity of the metal foam portion formed by the second slurry is about 80%. The porosity is a value measured on a single metal foam made of the first or second slurry.

EXAMPLE 3

Copper (Cu) powder having an average particle diameter (D50 particle diameter) of about 10 to 20 μm, polyvinyl acetate as a binder and alpha-terpineol as a dispersant were mixed in a weight ratio of 5:0.5:4.5 (copper powder:binder: dispersant) to prepare a first slurry. Furthermore, nickel (Ni) powder having an average particle diameter (D50 particle diameter) of about 10 to 20 μm, polyvinyl alcohol as a binder and propylene glycol as a dispersant were mixed in a weight ratio of 3:0.45:2.55 (nickel powder:binder:dispersant) to prepare a second slurry. In addition, copper (Cu) powder having an average particle diameter (D50 particle diameter) of about 10 to 20 μm, ethyl cellulose as a binder and texanol as a dispersant were mixed in a weight ratio of 3:0.9:8.1 (copper powder:binder: dispersant) to prepare a third slurry. First, the first slurry was coated in the form of a film and dried at about 115° C. for about 5 minutes to form a first metal foam precursor. At this time, the thickness of the coated metal foam precursor was about 200 μm or so. Subsequently, the second slurry was also coated on the first metal precursor in the form of a film and dried at about 120° C. for about 10 minutes to form a second metal foam precursor. At this time, the thickness of the coated second metal foam precursor was about 200 μm or so. Subsequently, the third slurry was also coated on the second metal precursor in the form of a film and dried at about 125° C. for about 8 minutes to form a third metal foam precursor. At this time, the thickness of the coated third metal foam precursor was about 200 μm or so. Subsequently, the laminate was heat-treated (sintered) at a temperature of 1,000° C. for 30 minutes in a 4% hydrogen/argon gas atmosphere to prepare a metal foam. Here, the porosity of the metal foam formed by the first slurry is about 74%, the porosity of the metal foam portion formed by the second slurry is about 51% and the porosity of the metal foam portion formed by the third slurry is about 85%. The porosity is a value measured on a single metal foam made of the first, second or third slurry.

What is claimed is:

1. A method for preparing a metal foam comprising steps of:

forming a first metal foam precursor using a first slurry containing a first metal powder, a first binder and a first dispersant;

forming a second metal foam precursor on the first metal foam precursor using a second slurry containing a second metal powder, a second binder and a second dispersant and having a composition different from that of the first slurry; and sintering the first and second metal foam precursors, wherein the first and second slurries do not comprise blowing agents, wherein the first slurry comprises 200 to 3,000 parts by weight of the first dispersant relative to 100 parts by weight of the first binder, wherein the second slurry comprises 200 to 3,000 parts by weight of the second dispersant relative to 100 parts by weight of the second binder, and wherein each of the first and second slurries does not comprise water or comprises water in an amount of 250 parts by weight or less relative to 100 parts by weight of the binder.

2. The method for preparing a metal foam according to claim 1, wherein the first slurry comprises 1 to 500 parts by weight of the first binder relative to 100 parts by weight of the first metal powder; and wherein the second slurry comprises 1 to 500 parts by weight of the second binder relative to 100 parts by weight of the second metal powder.

3. The method for preparing a metal foam according to claim 1, wherein the first or second metal powder has an average particle diameter in a range of 0.1 μm to 200 μm.

4. The method for preparing a metal foam according to claim 1, wherein the first or second binder is alkyl cellulose, polyalkylene carbonate or a polyvinyl alcohol-based binder.

5. The method for preparing a metal foam according to claim 1, wherein the first or second dispersant is an alcohol.

6. The method for preparing a metal foam according to claim 1, wherein the first or second slurry does not comprise water.

7. The method for preparing a metal foam according to claim 1, wherein the first or second metal foam precursor is formed in the form of a film or sheet.

8. The method for preparing a metal foam according to claim 1, wherein the sintering is performed at a temperature in a range of 500° C. to 2000° C.

9. The method for preparing a metal foam according to claim 1, wherein the first metal foam precursor and the second metal foam precursor are formed in contact with each other.

10. The method for preparing a metal foam according to claim 1, wherein the ratio (A/B) of the weight ratio (A) of the first metal powder in the first slurry to the weight ratio (B) of the second metal powder in the second slurry is in a range of 0.1 to 20.

11. The method for preparing a metal foam according to claim 1, wherein the ratio (C/D) of the parts by weight (C) of the first binder relative to 100 parts by weight of the first metal powder in the first slurry to the parts by weight (D) of the second binder relative to 100 parts by weight of the second metal powder in the second slurry is in a range of 0.01 to 20.

12. The method for preparing a metal foam according to claim 1, wherein the ratio (E/F) of the parts by weight (E) of the first dispersant relative to 100 parts by weight of the first metal powder in the first slurry to the parts by weight (F) of the second dispersant relative to 100 parts by weight of the second metal powder in the second slurry is in a range of 0.01 to 20.

13. The method for preparing a metal foam according to claim 1, wherein the first metal foam precursor is present in the gravity direction of the second metal foam precursor based on the second metal foam precursor.

14. The method for preparing a metal foam according to claim 1, wherein the first and second metal foam precursors together have a thickness of 2,000 μm or less.

15. The method for preparing a metal foam according to claim 1, wherein the forming of the first or second metal foam precursor is carried out by forming on a metal base material.

16. The method for preparing a metal foam according to claim 1, wherein the method further comprises a step of drying the first slurry after the forming of the first metal foam precursor.

17. The method for preparing a metal foam according to claim 1, wherein the first slurry comprises 500 to 3,000 parts by weight of the first dispersant relative to 100 parts by weight of the first binder, and wherein the second slurry comprises 500 to 3,000 parts by weight of the second dispersant relative to 100 parts by weight of the second binder.

18. The method for preparing a metal foam according to claim 1, wherein the ratio (A/B) of the weight ratio (A) of the first metal powder in the first slurry to the weight ratio (B) of the second metal powder in the second slurry is in a range of 1.5 to 20.

19. The method for preparing a metal foam according to claim 1, wherein the ratio (A/B) of the weight ratio (A) of the first metal powder in the first slurry to the weight ratio (B) of the second metal powder in the second slurry is in a range of 1 to 20.

20. The method for preparing a metal foam according to claim 1, wherein the first or second slurry does not comprise a solvent other than the dispersant.

* * * * *